United States Patent [19]

Harrsch

[11] 4,136,537

[45] Jan. 30, 1979

[54] DRUM-TYPE MACHINE FOR THE TREATMENT OF BATCHWISE TEXTILE MATERIAL

[75] Inventor: Ernst Harrsch, Marbach, Germany

[73] Assignee: Firma Gebr. Poensgen & Sulzmann GmbH, Germany

[21] Appl. No.: 881,857

[22] Filed: Feb. 27, 1978

[30] Foreign Application Priority Data

Feb. 25, 1977 [AT] Austria ..... 1296/77

[51] Int. Cl.[2] ..... D06F 21/04; D06F 37/00

[52] U.S. Cl. ..... 68/13 R; 68/27; 68/139; 34/89

[58] Field of Search ..... 68/13 R, 27, 58, 210, 68/139–146; 34/89; 69/30

[56] References Cited

U.S. PATENT DOCUMENTS 3,869,883 3/1975 Rotter ..... 68/58

FOREIGN PATENT DOCUMENTS 2606850 9/1976 Fed. Rep. of Germany ..... 68/27

*Primary Examiner*—Philip R. Coe

*Attorney, Agent, or Firm*—Craig & Antonelli

[57] ABSTRACT

A drum-type machine for the treatment of batchwise textile material, especially a washing machine, with at least one drive drum rotatably supported in an approximately horizontal position having a central opening in one end wall for loading purposes and a central opening in the other wall for unloading purposes, as well as a conveying paddle in the interior for moving the batch of material about within the drum during rotation of the drum in a first direction and for the axial transporting of the batch of material through the unloading aperture in the other direction of rotation of the drum is provided with a sensor having a feeler oriented into the loading and/or unloading aperture, wherein the feeler is effected by the batch of material moving through the loading and/or unloading opening and acts to generate a signal if a part of the batch of material remains in the zone of the aperture after unloading.

22 Claims, 2 Drawing Figures

DRUM-TYPE MACHINE FOR THE TREATMENT OF BATCHWISE TEXTILE MATERIAL

BACKGROUND AND SUMMARY OF THE INVENTION

The invention relates to a drum type machine for the treatment of batchwise textile material, especially a washing machine, with at least one driven drum rotatable supported in an approximately horizontal position and having a central opening in one end wall for loading purposes and a central opening in the other end wall for unloading purposes, as well as a conveying paddle in the interior for moving the batch of material in the drum and for the axial transporting of the batch of material through the unloading aperture in the other direction of rotation of the drum.

Drum-type machines have been known wherein the drum is loaded through one end wall and again unloaded through the other end wall. The unloading of the batch of material present in the drum is either controlled chronologically, i.e., the drum rotates for a preset period of time for unloading purposes, or it is controlled in dependence on the direction of rotation, i.e., the unloading is executed by reversing the direction of rotation, essentially during one full revolution of the drum. In the latter method, the batch of material is fed mechanically and forcibly by means of a conveying paddle to the unloading aperture. The adjustment and construction of the drum in the two conventional processes is based on experiential values indicating when normally all pieces of the batch of material have left the drum. However, due to unforeseeable influences, it can happen repeatedly that, after termination of the preprogrammed unloading step, not all pieces have been discharged as yet from the drum, and such pieces are in almost all cases in the zone of the unloading aperture, for example they have become jammed at that point. This not only results in an intermixing of various batches of materials, but also in disturbances during the treatment procedure, especially in case of multiple-drum machines, e.g. washing machines, so that the machine can clog up under certain circumstances, whereupon it can be returned into operation only under considerable expenditures of work and time.

It is an object of this invention to provide a drum-type machine improved in this respect, wherein the conveyance of the batch of material through the drum is effected in a controlled fashion.

This object is attained, in accordance with a preferred embodiment of the invention, by providing a sensor with a feeler oriented into the loading and/or unloading aperture, wherein the feeler is changed by the batch of material moved through the loading and/or unloading opening.

In a further embodiment of the invention, a particularly advantageous construction is obtained by arranging the sensor in the lower zone of the loading and/or unloading aperture with a preferably upwardly directed feeler.

Another feature of the invention is characterized by connecting the sensor with a switching device, especially for the drum drive mechanism.

The advantages attained by this invention reside particularly in that the sensor monitors at the loading and/or unloading aperture of the drum the passage of the batch of material during the conveying phase. Each part of the batch of material remaining in the zone of the aperture produces a signal indicating or directly initiating a correction. By arranging the sensor in the lower zone of the aperture, it is thus also possible to detect individual pieces, particularly those having small dimensions, with certainty. By connecting the sensor with a switching device, the control of the machine can thus be directly affected, for example, the drum drive mechanism can be additionally controlled, in order to eliminate the disturbance. Furthermore, it is possible to produce signals for the operating personnel so that possibly a manual intervention can take place to avoid large-size interruptions or blockages. The provision of the sensor at the loading and/or unloading aperture therefore results in an increased safety during the automatic operation of a drum which can be loaded and unloaded axially, especially in case of multiple-drum machines, namely with respect to the optimum separation of the batches, as well as an increased operating safety.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
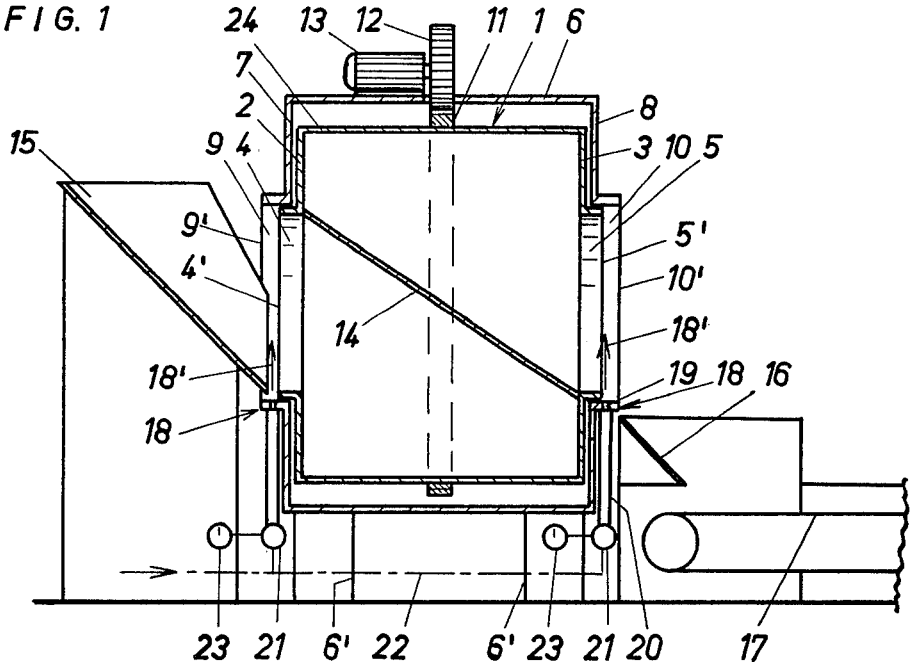
FIG. 1 is a longitudinal section through a single-drum machine.

The drum-type machine according to FIG. 1 represents a continuous washing machine for batchwise material, the only drum 1 of which is supported to be rotatable about a horizontal axis. In both end walls 2 and 3, respectively, one central aperture 4 and 5 is provided. Since, in FIG. 1, the direction of movement of the material is assumed to be from the left toward the right, the aperture 4 represents the loading opening and the aperture 5 is the unloading opening. The drum 1 is surrounded by a stationary housing 6 disposed on the floor with feet 6' and equipped on both end walls 7 and 8 with apertures 9 and 10 corresponding to the apertures 4 and 5. All apertures 4, 5, 9, and 10 are lined with a ring 4', 5', 9', and 10' in such a way that the rings 4' and 5' run within the rings 9' and 10'. These rings 4' and 5' or 9' and 10' can simultaneously be fashioned as bearings for the drum 1. A serrated ring 11 is disposed around the entirely or partially perforated drum jacket 24, in which meshes a pinion 12 of a geared engine 13 attached to the housing 6, in order to drive the drum 1 in one or the other direction of rotation.

A conveying paddle 14 is conventionally arranged in the drum 1, this paddle moving the batch of material during the treatment phase in one direction of rotation essentially radially and discharging the batch of material during the transporting phase in the other direction of rotation axially through the unloading aperture 5 from the drum. Such paddles are shown, for example, in German Offenlegungsschrift 24 24 509. By feed means provided at the housing 6 and not shown, water and other additives are introduced into the housing 6 and the drum 1. A heating means is likewise provided in an equally conventional manner.

To introduce the batch of material into the drum 1, a funnel 15 is provided which terminates in the loading opening 4. For discharging the batch of material, which has fallen out of the drum-type machine, a chute 16 is connected to the unloading aperture 5, this chute terminating above a conveyor belt 17.

A sensor 18 is arranged in the lower zone of the ring 10', preferably at the lowest point thereof; this sensor has a feeler 18' oriented into the plane of the unloading aperture 5. According to FIG. 1, the feeler 18' extends vertically in the upward direction. It is noted that the term feeler is being utilized in the present context to mean a physical, fluidic, optical or other formation which will feel the effect of (or be affected by) material traveling so as to come against it.

The drawing shows an embodiment wherein a sensor 18 is exposed pneumatically or hydraulically to a pressure medium, comprising a nozzle 19 in the ring 10', this nozzle being connected to a pressure switch 21 via a conduit 20. The pressure switch is in communication with an arbitrary source of pressure medium via a pressure line 22. The pressure switch 21 is electrically connected to a switching device 23.

During the treatment phase, the outlet of nozzle 19 is unblocked, and the pressure medium can exit practically without any pressure forming the feeler 18'. However, if the outlet of nozzle 19 is covered by a piece of material, then the efflux of the pressure medium is entirely or partially inhibited, i.e., the feeler 18' is disturbed. Thereby, the pressure in the conduit 20 is increased, and thus the pressure in the pressure switch 21 also rises, so that the latter responds and transmits a switching pulse to the switching unit 23. The latter can be fashioned to be merely a signaling device which indicates to the operating personnel acoustically and/or optically that a piece of material is present in the unloading aperture 5, i.e., the transporting step is not, or not as yet, fully completed. Since the nozzle 19 may be covered only during the unloading phase, one can thus see whether or not, after termination of the preset unloading phase, all pieces of the batch of material have left the drum 1. If pieces are still present in the unloading aperture 5, then these can be removed manually, or the unloading revolution of drum 1 can be repeated. Of course, this test can also be executed automatically by scanning the pressure ambient at the end of the unloading phase. If the pressure is at its normal, low level, then the washing step is continued by loading the subsequent batch of material into the drum 1, while, if the pressure has risen and the pressure switch 21 has responded, the geared motor 13 is turned on for one or even several additional revolutions of drum 1 in the direction of rotation for unloading. Only when the pressure is normal is the washing cycle anew initiated.

In contrast thereto, if the pressure still has not dropped to a normal level even after a preset number of additional unloading revolutions of the drum 1, the machine will enter the breakdown phase. Of course, the pressure increases during the normal unloading procedure are not evaluated, i.e., they are neither measured nor suppressed.

A corresponding sensor 18 can also be provided at the loading opening 4 to control the loading from funnel 15. The function takes place analogously to the above description.

Figure 2:
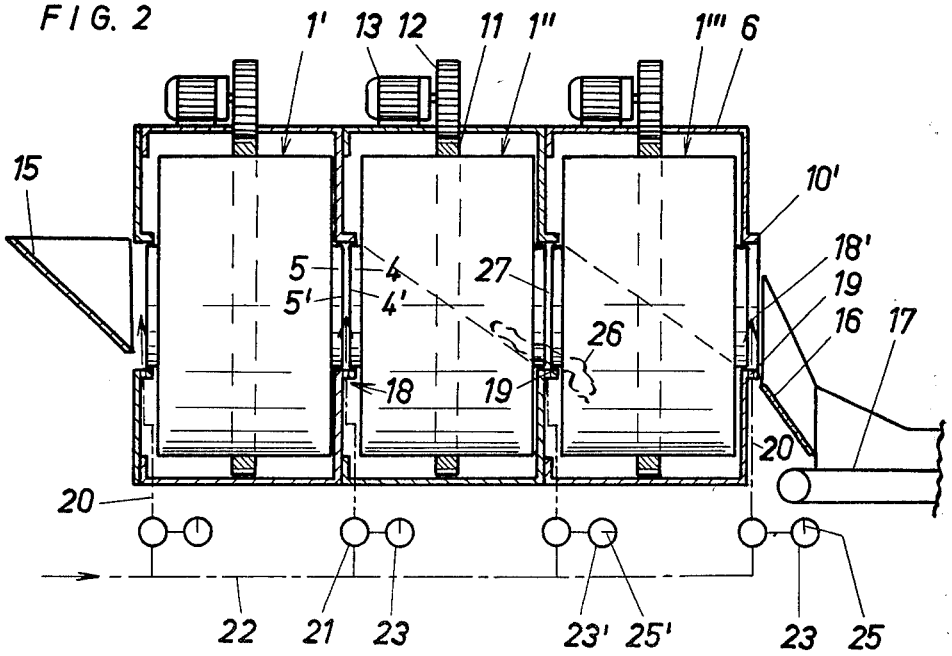
FIG. 2 is a longitudinal section through a multiple-drum machine.

FIG. 2 shows a drum-type washing machine with several drums 1 arranged in axial succession. The bearing, construction, and drive mechanism of the drums 1 correspond to the embodiment of FIG. 1. Therefore, identical parts carry the same reference numerals. The sensor 18 is arranged within the machine in the gap between the adjacent rings 4' and 5' of the unloading aperture 5 and the subsequent loading aperture 4, respectively.

The unloading phase begins with the last drum 1'''. Once the latter has been entirely unloaded and the pressure in the associated sensor 18 has returned to normal, as indicated by the vertically oriented indicator needle 25 of the switching device 23, the unloading phase of drum 1'' is initiated. However, this drum has not completed the unloading step at the end of its unloading phase, as indicated by the piece 26 lying on the nozzle 19, so that the pressure in the sensor 18 is increased, as illustrated by the horizontally oriented indicator needle 25' in the switching device 23'. Therefore, the unloading operation is repeated until this disturbance is eliminated. Only thereafter is the drum 1' also rotated into the unloading position. Once the unloading process is completed, the drum 1' is reloaded and the subsequent washing cycle of the machine is begun after resetting a sensor 18 which is optionally directed into the loading aperture 4 on the inlet side.

The sensor 18 can be under constant exposure to pressure medium or the latter can be made effective thereon only during the time period for measuring. Furthermore, the sensor can also be fashioned as a light barrier. The use of a switch actuating rocker arm is also possible, and several sensors can be arranged at one aperture, for example with intersecting feelers 18'. The feeler 18' can also be oriented approximately horizontally in the lower zone of the aperture 4 or 5 (represented by the dash line arrow, FIG. 2). Furthermore, the sensor can finally also be equipped with a transmitter portion and a receiver portion so that the interruption of the feeler in the form of a stream of pressure medium or a light beam triggers the signal in the receiver portion.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In a drum-type machine for the treatment of batchwise textile material, especially a washing machine, of the type having at least one driven drum rotatably supported in an approximately horizontal position and having an opening in one end wall for loading purposes and an opening in the other end wall for unloading purposes, as well as a conveying paddle in the interior for moving the batch of material in an approximately radial plane in one direction of rotation of the drum and for the axial transportation of the batch of material through the unloading aperture in the other direction of rotation of the drum, the improvement comprised in that a sensor means is provided oriented into at least the loading or unloading opening for producing an indication as a result of a batch of material moving through the respective loading or unloading aperture.

2. A drum-type machine according to claim 1, characterized in that the sensor means is arranged in the lower zone of the respective loading or unloading opening.

3. A drum-type machine according to claim 2, characterized in that the sensor means is connected to a switching device.

4. A drum-type machine according to claim 3, wherein the switching device controls a drum drive mechanism.

5. A drum-type maching according to claim 2, characterized in that the sensor means comprises at least one feeler disposed in the loading or unloading aperture.

6. A drum-type machine according to claim 5, wherein said feeler extends vertically.

7. A drum-type machine according to claim 5, wherein said feeler extends horizontally.

8. Drum-type maching according to claim 5, characterized in that said sensor means includes several sensors which are provided at one loading or unloading opening.

9. A drum-type machine according to claim 5, wherein said sensor means includes sensors at both said loading and unloading openings.

10. A drum-type machine according to claim 5, wherein said machine has multiple drums and said sensor means includes sensors in said loading opening, said unloading opening and an aperture interconnecting two of said multiple drums.

11. A drum-type machine according to claim 1, characterized in that the sensor means is connected to a switching device.

12. A drum-type machine according to claim 11, wherein the switching device controls a drum drive mechanism.

13. A drum-type machine according to claim 11, characterized in that the sensor means comprises a nozzle fed by a feed conduit with a pressure medium such as compressed air.

14. A drum-type machine according to claim 13, characterized in that a pressure switch is provided in the feed conduit to the nozzle.

15. A drum-type machine according to claim 1, characterized in that the sensor means comprises a nozzle fed by a feed conduit with a pressure medium such as compressed air.

16. A drum-type machine according to claim 15, characterized in that a pressure switch is provided in the feed conduit to the nozzle.

17. A drum-type machine according to claim 1, characterized in that the sensor means comprises at least one feeler disposed in the loading or unloading aperture.

18. A drum-type machine according to claim 17, wherein said feeler extends vertically.

19. A drum-type machine according to claim 17, wherein said feeler extends horizontally.

20. Drum-type machine according to claim 1, characterized in that said sensor means includes several sensors which are provided at one loading or unloading opening.

21. A drum-type machine according to claim 1, wherein said sensor means includes sensors at both said loading and unloading openings.

22. A drum-type machine according to claim 1, wherein said machine has multiple drums and said sensor means includes sensors in said loading opening, said unloading opening and an aperture interconnecting two of said multiple drums.

* * * * *